US010815450B2

(12) United States Patent
Saveyn et al.

(10) Patent No.: US 10,815,450 B2
(45) Date of Patent: Oct. 27, 2020

(54) FABRIC SOFTENER COMPOSITION HAVING IMPROVED VISCOSITY STABILITY

(71) Applicant: The Procter & Gamble Company, Cincinnati, OH (US)

(72) Inventors: Pieter Jan Maria Saveyn, Heusden (BE); Katrien Maria Nuyts, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/195,929

(22) Filed: Nov. 20, 2018

(65) Prior Publication Data

US 2019/0161702 A1 May 30, 2019

(30) Foreign Application Priority Data

Nov. 28, 2017 (EP) ..... 17204043

(51) Int. Cl.

| | |
|---|---|
| ***C11D 1/83*** | (2006.01) |
| ***C11D 3/00*** | (2006.01) |
| ***C11D 3/20*** | (2006.01) |
| ***C11D 3/50*** | (2006.01) |
| ***C11D 1/62*** | (2006.01) |
| ***C11D 3/30*** | (2006.01) |

(52) U.S. Cl.

CPC ..... *C11D 3/0015* (2013.01); *C11D 1/62* (2013.01); *C11D 3/2093* (2013.01); *C11D 3/30* (2013.01); *C11D 3/50* (2013.01)

(58) Field of Classification Search

CPC ..... C11D 1/667; C11D 3/001; C11D 3/0015; C11D 3/126; C11D 3/2093; C11D 1/62; C11D 1/835; C11D 3/50

See application file for complete search history.

(56) References Cited

U.S. PATENT DOCUMENTS

| | | | | |
|---|---|---|---|---|
| 5,358,647 | A | 10/1994 | Puentes-Bravo et al. | |
| 5,726,144 | A | 3/1998 | Dewez et al. | |
| 5,750,492 | A | 5/1998 | Contet et al. | |
| 2003/0162689 | A1* | 8/2003 | Schymitzek ..... | C11D 3/0015 510/515 |
| 2011/0219730 | A1* | 9/2011 | Corona, III ..... | C11D 1/62 53/467 |

FOREIGN PATENT DOCUMENTS

| | | | |
|---|---|---|---|
| EP | 0845523 | A2 | 6/1998 |
| WO | WO2007026314 | A2 | 3/2007 |

OTHER PUBLICATIONS

Extended European Search Report; Application No. 17204043.8-1105; dated Apr. 26, 2018; 6 pages.

* cited by examiner

*Primary Examiner* — John R Hardee

(74) *Attorney, Agent, or Firm* — Gregory S. Darley-Emerson

(57) ABSTRACT

Fabric softener compositions that include a quaternary ammonium ester fabric softening active, dispersed perfume, and a pentaerythritol ester, the compositions exhibiting viscosity stability while also delivering the softening benefits that are desired by consumers. Methods of making same.

15 Claims, 3 Drawing Sheets

Apparatus B Example
Circulation Loop System

FABRIC SOFTENER COMPOSITION HAVING IMPROVED VISCOSITY STABILITY

FIELD OF THE INVENTION

The present disclosure is directed to liquid fabric softener compositions.

BACKGROUND OF THE INVENTION

Liquid fabric softener compositions provide benefits to treated fabrics, particularly in the rinse phase of the laundry process, after the addition of the detergent composition. Such benefits include fabric softening, provided by the incorporation of fabric softener actives. Such actives are typically quaternary ammonium esters of fatty acids and typically form vesicles in aqueous dispersions. Another important benefit of liquid fabric softener compositions is providing a pleasant smell to treated fabrics, delivered by the incorporation of perfumes into the fabric softener compositions However, liquid fabric softener compositions comprising quaternary ammonium ester softening active and perfume can exhibit instability upon storage. Without wishing to be bound by theory, it is believed that due to the presence of hydrophobic moieties, fabric softener actives are prone to interact with perfumes, resulting in either phase splitting, or a less stable viscosity profile upon storage. Especially increasing viscosity upon storage can result in difficult dosing of the composition and can lead to higher levels of undispensed product remaining in the bottle, and residues in the washing machine dispenser.

Hence a need remains for a fabric softener composition comprising a fabric softening active and dispersed perfume which has improved viscosity stability and improved phase stable.

EP0845523A2 relates to ingredients preventing viscosity problems encountered in a perfumed liquid concentrated fabric softener. Propylene glycol dicaprylate/dicaprate, trioctyl citrate and dioctyl adipate were cited to be highly efficient. Isopropyl myristate was cited to be reasonably efficient. U.S. Pat. No. 5,358,647 relates to fabric softening products including as fabric softening components higher fatty acid esters of pentaerythritol, of pentaerythritol oligomers, or of ethoxylated derivatives of such pentaerythritol or oligomer esters together with a clay of the montmorillonite type in efforts to find a replacement for quaternary ammonium salts. U.S. Pat. No. 5,726,144 A relates to fabric softening compositions which form and maintain stable aqueous dispersions in the absence of oily perfume wherein the fabric softener is a combination of an amide or amine with a quaternary ammonium compound, further comprising a fatty ester of mono or polyhydric alcohols. WO 2007/026314A2 relates to concentrated fabric softening compositions comprising from about 60% to about 97% of a fabric softening active and a diluent wherein the concentrated softening composition comprises less than 6% water by weight of the composition.

SUMMARY OF THE INVENTION

The present disclosure is directed to a liquid fabric softener composition comprising by weight of the composition from 2% to 25% of a quaternary ammonium ester fabric softening active, 0.1% to 7% of dispersed perfume, and 0.1% to 5% of a pentaerythritol ester. In another aspect, the present invention relates to the process of making same.

One aim of the present disclosure is to provide a liquid fabric softener composition with improved viscosity stability and pourability. Another aim of the present disclosure is to provide a composition as described herein, having sufficient properties, such as for example, softness benefits, a pleasant smell, and/or visual appearance, which are consumer acceptable.

BRIEF DESCRIPTION OF THE DRAWINGS

While the specification concludes with claims particularly pointing out and distinctly claiming the invention, it is believed that the invention will be better understood from the following accompanying figures.

DETAILED DESCRIPTION OF THE INVENTION

Definitions

Figure 1:
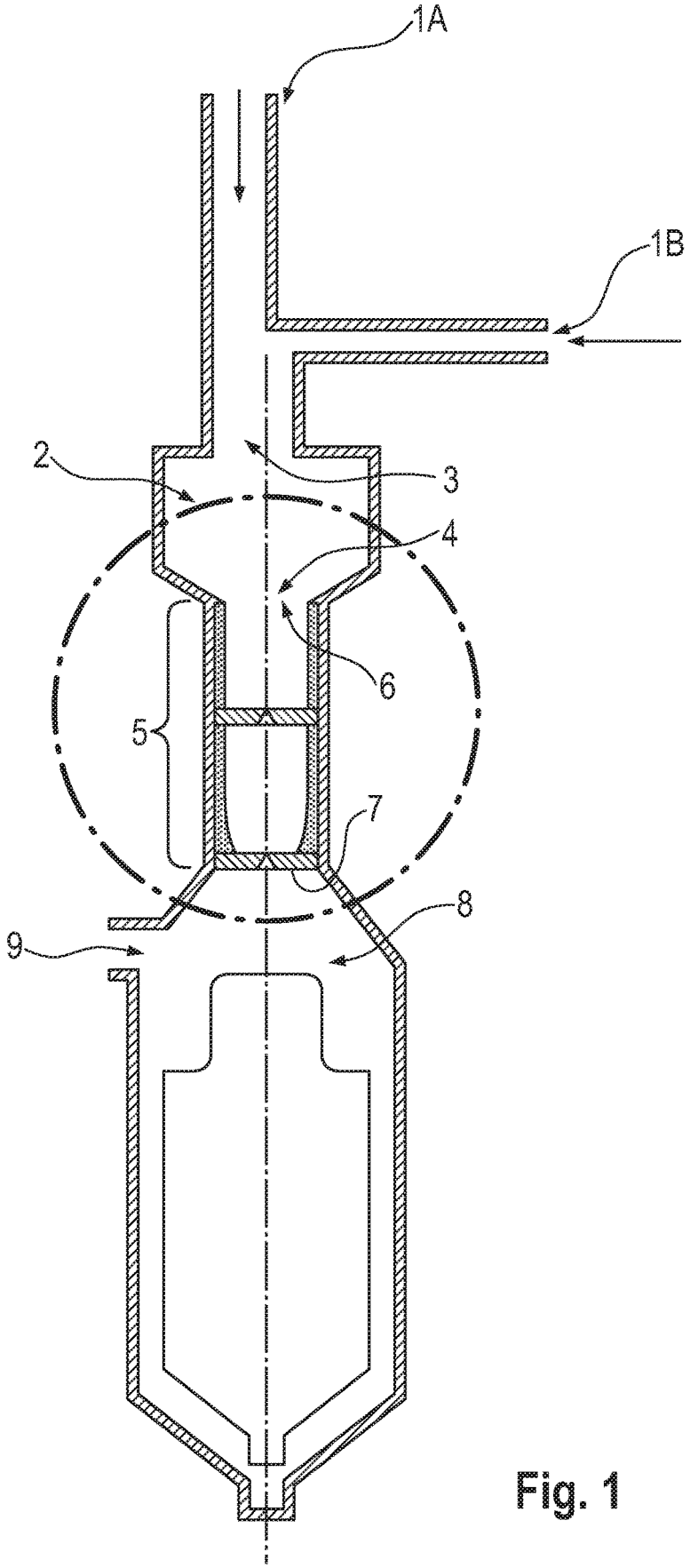
FIG. 1 details the apparatus.

As used herein, the articles including "a" and "an" when used in a claim, are understood to mean one or more of what is claimed or described.

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions. For example, it is known that quaternary ammonium esters typically contain the following impurities: the monoester form of the quaternary ammonium ester, residual non-reacted fatty acid, and non-quaternized esteramines.

All percentages and ratios are calculated by weight unless otherwise indicated. All percentages and ratios are calculated based on the total composition unless otherwise indicated.

All ratios are calculated as a weight/weight level of the active material, unless otherwise specified.

All measurements are performed at 25° C. unless otherwise specified.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The Liquid Fabric Softener Composition

As used herein, "liquid fabric softener composition" refers to any treatment composition comprising a liquid capable of softening fabrics e.g., clothing in a domestic washing machine. The composition can include solids or gases in suitably subdivided form, but the overall composition excludes product forms which are non-liquid overall, such as tablets or granules.

Aqueous liquid fabric softening compositions are preferred. For such aqueous liquid fabric softener compositions, the water content can be present at a level of from 5% to 98%, preferably from 50% to 96%, more preferably from 70% to 95% by weight of the liquid fabric softener composition.

The pH of the neat fabric softener composition is typically acidic to improve hydrolytic stability of the quaternary ammonium ester softening active and may be from pH 2.0 to 6.0, preferably from pH 2.0 to 4.5, more preferably from pH 2.0 to 3.5 (see Methods).

To provide a rich appearance while maintaining pourability of the fabrics softener composition, the viscosity of the fabric softener composition may be from 50 mPa·s to 800 mPa·s, preferably from 70 mPa·s to 600 mPa·s, more preferably from 100 mPa·s to 500 mPa·s as measured with a Brookfield® DV-E rotational viscometer (see Methods).

Stabilizer—Pentaerythritol Ester

The liquid fabric softener composition of the present invention comprises by weight of the composition from 0.1% to 5%, preferably 0.2% to 4%, more preferably from 0.3% to 3%, even more preferably from 0.4% to 2%, most preferably from 0.5% to 1.5% of a pentaerythritol ester according to formula

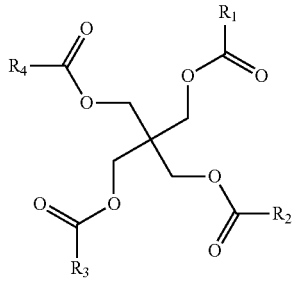

wherein each $R_1$, $R_2$, $R_3$, $R_4$ is independently selected from C3-C15 linear or branched, saturated or unsaturated alkyl chains.

The pentaerythritol ester stabilizer surprisingly improves the viscosity stability upon storage and hence improves the pouring experience of the liquid fabric softener compositions comprising dispersed perfume. Without wishing to be bound by theory, it is believed that through its geometry the stabilizer reduces the microstructural changes induced by the interaction between perfume and the quaternary ammonium ester softening active.

Preferably, each $R_1$, $R_2$, $R_3$, $R_4$ is independently selected from C6-C12 linear, saturated or unsaturated, alkyl chains; more preferably each $R_1$, $R_2$, $R_3$, $R_4$ is independently selected from C6-C12 saturated linear alkyl chains; even more preferably each $R_1$, $R_2$, $R_3$, $R_4$ is independently selected from C7-C9 linear saturated alkyl chains.

Preferably, the ratio of quaternary ammonium ester softening active to pentaerythritol ester is from 200:1 to 2:1, preferably from 100:1 to 5:1, more preferably from 75:1 to 10:1.

Preferably, the ratio of pentaerythritol ester to dispersed perfume is from 10:1 to 1:10, preferably from 5:1 to 1:5, more preferably from 3:1 to 1:4.

The pentaerythritol ester may be added to the liquid fabric softener composition as a separate ingredient or can be premixed with the quaternary ammonium ester softening active, or preferably premixed with the perfume prior to making the liquid fabric softener composition. Premixing pentaerythritol ester with perfume further improves viscosity stability and reduces formulation complexity at the same time because a perfume-pentaerythritol mixture can be dosed with one dosing system instead of two dosing systems.

The Quaternary Ammonium Ester Softening Active

The liquid fabric softener composition of the present invention comprises from 2% to 25%, preferably from 3% to 20%, more preferably from 3% to 17%, most preferably from 4% to 15% of a quaternary ammonium ester softening active (Fabric Softening Active, "FSA"). The level of quaternary ammonium ester softening active may depend of the desired concentration of total softening active in the composition (diluted or concentrated composition) and of the presence or not of other softening actives. However, the risk on increasing viscosities and phase instabilities over time is typically higher in fabric softener compositions with higher FSA levels. On the other hand, at very high FSA levels, the viscosity becomes more difficult to control.

Preferably, the iodine value (see Methods) of the parent fatty acid from which the quaternary ammonium fabric softening active is formed is from 5 to 60, more preferably from 10 to 45, even more preferably from 15 to 40. Without being bound by theory, lower melting points resulting in easier processability of the FSA are obtained when the parent fatty acid from which the quaternary ammonium fabric softening active is formed is at least partially unsaturated. Especially double unsaturated fatty acids enable easy to process FSA's.

Suitable quaternary ammonium ester softening actives include but are not limited to, materials selected from the group consisting of monoester quats, diester quats, triester quats and mixtures thereof. Preferably, the level of monoester quat is from 2.0% to 40.0%, the level of diester quat is from 40.0% to 98.0%, the level of triester quat is from 0.0% to 25.0% by weight of total quaternary ammonium ester softening active.

Said quaternary ammonium ester softening active may comprise compounds of the following formula:

$$\{R^2_{(4-m)}—N+-[X—Y-R^1]_m\}A-$$

wherein:

m is 1, 2 or 3 with proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently —$(CH_2)_n$—, —$CH_2$—CH($CH_3$)— or —CH($CH_3$)—$CH_2$— and each n is independently 1, 2, 3 or 4, preferably each n is 2;

each Y is independently —O—(O)C— or —C(O)—O—;

A- is independently selected from the group consisting of chloride, methyl sulfate, and ethyl sulfate, preferably A- is selected from the group consisting of chloride and methyl sulfate, more preferably A- is methyl sulfate;

with the proviso that when Y is —O—(O)C—, the sum of carbons in each $R^1$ is from 13 to 21, preferably from 13 to 19. While the issue of increasing viscosity is bigger when the softener-compatible anion (A-) is methyl sulfate, it is the preferred softener-compatible anion because it facilitates the quaternization step in the manufacturing of the quaternary ammonium ester softening active.

Examples of suitable quaternary ammonium ester softening actives are commercially available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

These types of agents and general methods of making them are disclosed in U.S. Pat. No. 4,137,180.

Dispersed Perfume

The liquid fabric softener composition of the present invention comprises a dispersed perfume composition. By dispersed perfume we herein mean a perfume composition that is freely dispersed in the fabric softener composition and is not encapsulated. Perfume is typically added to provide the fabric softener composition with a pleasant smell. A perfume composition comprises one or more perfume raw materials. Perfume raw materials are the individual chemical compounds that are used to make a perfume composition. The choice of type and number of perfume raw materials is dependent upon the final desired scent. In the context of the present invention, any suitable perfume composition may be used. Those skilled in the art will recognize suitable compatible perfume raw materials for use in the perfume composition, and will know how to select combinations of ingredients to achieve desired scents.

The level of dispersed perfume is from 0.1% to 7%, preferably from 0.5% to 6%, more preferably from 1.0% to 5.0% by weight of the liquid fabric softener composition.

The perfume composition may comprise from 2.5% to 30%, preferably from 5% to 30% by total weight of the perfume composition of perfume raw materials characterized by a log P lower than 3.0, and a boiling point lower than 250° C.

The perfume composition may comprise from 5% to 30%, preferably from 7% to 25% by total weight of the perfume composition of perfume raw materials characterized by having a log P lower than 3.0. The perfume composition may comprise from 35% to 60%, preferably from 40% to 55% by total weight of the perfume composition of perfume raw materials characterized by having a log P higher than 3.0. The perfume composition may comprise from 10% to 45%, preferably from 12% to 40% by total weight of the perfume composition of perfume raw materials characterized by having a log P higher than 3.0. Perfume raw materials with a log P higher than 3.0 deposit well on fabrics because of their hydrophobicity. However, viscosity instability can be higher with more hydrophobic perfume raw materials. The present invention exhibits improved viscosity stability even in presence of such hydrophobic perfume raw materials.

Preferred fabric softener compositions comprise dispersed perfume consisting of at least 20% by total weight of the perfume composition of perfume raw materials selected from the list consisting of alcohols, aldehydes containing a benzyl group, linalyl acetate, and mixtures thereof.

Particles

The liquid fabric softener composition of the present invention may also comprise particles. The liquid fabric softener composition may comprise, based on the total liquid fabric softener composition weight, from 0.02% to 10%, preferably from 0.1% to 4%, more preferably from 0.25% to 2.5% of particles. Said particles include beads, pearlescent agents, encapsulated benefit agents, and mixtures thereof.

Encapsulated Benefit Agent:

The liquid fabric softener composition may comprise from 0.05% to 10%, preferably from 0.05% to 3%, more preferably from 0.05% to 2% by weight of encapsulated benefit agent. The benefit agent is selected from the group consisting of perfume compositions, moisturizers, a heating or cooling agent, an insect/moth repellent, germ/mould/mildew control agents, softening agents, antistatic agents, anti-allergenic agents, UV protection agents, sun fade inhibitors, hueing dyes, enzymes and combinations thereof, colour protection agents such as dye transfer inhibitors, bleach agents, and combinations thereof. Perfume compositions are preferred.

The benefit agent is encapsulated, for instance, as part of a core in one or more capsules. Such cores can comprise other materials, such as diluents, solvents and density balancing agents.

The capsules have a wall, which at least partially, preferably fully surrounds the benefit agent comprising core. The capsule wall material may be selected from the group consisting of melamine, polyacrylamide, silicone, silica, polystyrene, polyurea, polyurethanes, polyacrylate based material, polyacrylate esters based material, gelatin, styrene malic anhydride, polyamide, aromatic alcohols, polyvinyl alcohol, resorcinol-based materials, poly-isocyanate-based materials, acetals (such as 1,3,5-triol-benzene-gluteraldehyde and 1,3,5-triol-benzene melamine), starch, cellulose acetate phthalate and mixtures thereof.

Preferably, the capsule wall comprises one or more wall material comprising melamine, polyacrylate based material and combinations thereof.

Said melamine wall material may be selected from the group consisting of melamine crosslinked with formaldehyde, melamine-dimethoxyethanol crosslinked with formaldehyde, and combinations thereof.

Said polyacrylate based material may be selected from the group consisting of polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer and combinations thereof.

Polyurea capsules can comprise a polyurea wall which is the reaction product of the polymerisation between at least one polyisocyanate comprising at least two isocyanate functional groups and at least one amine, preferably a polyfunctional amine as a cross-linker and a colloidal stabilizer.

Suitable capsules can be obtained from Encapsys (Appleton, Wis., USA). The fabric softener compositions may comprise combinations of different capsules, for example capsules having different wall materials and/or benefit agents.

Perfume compositions are the preferred encapsulated benefit agent.

Ratio of Encapsulated Benefit Agent to Dispersed Perfume Oil

The liquid fabric softener composition may comprise a ratio of perfume oil encapsulates to free dispersed perfume oil of from 3:1 to 1:40, preferably from 1:1 to 1:20, more preferably from 1:2 to 1:10.

Additional Fabric Softening Active

The liquid fabric softener composition of the present invention may comprise from 0.01% to 10%, preferably from 0.1% to 10%, more preferably from 0.1% to 5% by weight of fabric softener composition of an additional fabric softening active. Suitable fabric softening actives, include, but are not limited to, materials selected from the group consisting of non-ester quaternary ammonium compounds, amines, fatty esters, sucrose esters, silicones, dispersible polyolefins, polysaccharides, fatty acids, softening oils, polymer latexes and combinations thereof.

Non-limiting examples of non-ester quaternary ammonium compounds include dialkylenedimethylammonium salts such as dicanoladimethylammonium chloride, di(hard) tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

Non-Ionic Surfactants

The composition may comprise, based on the total liquid fabric softener composition weight, from 0.01% to 10%, preferably from 0.01% to 5%, more preferably from 0.1% to 3.0%, most preferably from 0.5% to 2.0% of a non-ionic surfactant, preferably ethoxylated non-ionic surfactant, more preferably an ethoxylated non-ionic surfactant having a hydrophobic lipophilic balance value of 8 to 18. Non-ionic surfactants facilitate dispersing perfume into the fabric softener composition.

Examples of suitable non-ionic surfactants are commercially available from BASF under the tradename Lutensol AT80 (ethoxylated alcohol with an average degree of ethoxylation of 80 from BASF), from Clariant under the tradename Genapol T680 (ethoxylated alcohol with an average degree of ethoxylation of 68), from Sigma Aldrich under the tradename Tween 20 (polysorbate with an average degree of ethoxylation of 20).

Further Perfume Delivery Technologies

The liquid fabric softener composition may comprise one or more perfume delivery technologies that stabilize and enhance the deposition and release of perfume ingredients from treated substrate. Such perfume delivery technologies can be used to increase the longevity of perfume release from the treated substrate. Perfume delivery technologies, methods of making certain perfume delivery technologies and the uses of such perfume delivery technologies are disclosed in US 2007/0275866 A1.

The liquid fabric softener composition may comprise from 0.001% to 20%, from 0.01% to 10%, or from 0.05% to 5%, or even from 0.1% to 0.5% by total weight of fabric softener composition of the perfume delivery technology. Said perfume delivery technologies may be selected from the group consisting of: pro-perfumes, cyclodextrins, zeolite and inorganic carrier, and combinations thereof.

Deposition Aid

The liquid fabric softener composition may comprise, based on the total liquid fabric softener composition weight, from 0.0001% to 3%, preferably from 0.0005% to 2%, more preferably from 0.001% to 1% of a deposition aid. The deposition aid may be a cationic or amphoteric polymer. The cationic polymer may comprise a cationic acrylate. Cationic polymers in general and their method of manufacture are known in the literature. Deposition aids can be added concomitantly with particles or directly in the liquid fabric softener composition. Preferably, the deposition aid is selected from the group consisting of polyvinylformamide, partially hydroxylated polyvinylformamide, polyvinylamine, polyethylene imine, ethoxylated polyethylene imine, polyvinylalcohol, polyacrylates, chitosans, and combinations thereof.

The weight-average molecular weight of the polymer may be from 500 to 5000000 or from 1000 to 2000000 or from 2500 to 1500000 Dalton, as determined by size exclusion chromatography relative to polyethyleneoxide standards using Refractive Index (RI) detection. In one aspect, the weight-average molecular weight of the cationic polymer may be from 500 to 37500 Dalton.

Rheological Modifier

With "rheological modifier" we herein mean a compound which increases the viscosity of the fabric softener composition. Preferably, the liquid fabric softener composition comprises by weight of the composition from 0.01% to 5%, more preferably from 0.02% to 2%, even more preferably from 0.1% to 1% of a rheological modifier, preferably wherein said rheological modifier is selected from the list comprising cationic polymers, amphoteric polymers, and polysaccharides, more preferably wherein said rheological modifier is selected from the list consisting of cationic polymers and polysaccharides, even more preferably wherein said rheological modifier is selected from the list consisting of cationic polymers and cellulose fibers. The rheological modifier may be added to connote richness to the liquid fabric softener composition while it also reduces splashing and facilitates accurate dosing. The type and level of rheological modifier depends on the overall liquid fabric softener composition and the desired viscosity.

The rheological modifier may be selected from the list comprising cationic polymers, amphoteric polymers, and polysaccharides. The cationic polymer may comprise a cationic acrylate such as Rheovis® CDE. One group of suitable cationic polymers includes those produced by polymerization of ethylenically unsaturated monomers using a suitable initiator or catalyst, such as those disclosed in U.S. Pat. No. 6,642,200.

The polymer may optionally be branched or cross-linked by using branching and crosslinking monomers. Branching and crosslinking monomers include ethylene glycoldiacrylate divinylbenzene, and butadiene.

Suitable rheological modifiers include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

The rheological modifier may comprise poly(acrylamide-N-dimethyl aminoethyl acrylate) and its quaternized derivatives. The rheological modifier may be sold under the tradename Sedipur®, available from BTC Specialty Chemicals, a BASF Group, Florham Park, N.J. The rheological modifier may comprise poly(acrylamide-co-methacrylamidopropyltrimethyl ammonium chloride).

The rheological modifier may be selected from the group consisting of cationic or amphoteric polysaccharides. The rheological modifier may be selected from the group consisting of cationic and amphoteric cellulose ethers, cationic or amphoteric galactomanan, cationic guar gum, cationic or amphoteric starch, and combinations thereof.

The rheological modifier may be selected from cationic polymers such as alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

Suitable cationic rheological modifiers may be obtained by polymerisation of a cationic monomer and a monomer with hydrophobic nature and a non-ionic monomer. In particular, the cationic rheological modifier may be as disclosed in WO2011/148110. The cationic rheological modifier may be supplied by SNF, such as Flosoft® FS222.

The rheological modifier may be cellulose fibers. With cellulose fibers it is meant herein cellulose micro or nano fibrils. The cellulose fibers can be of bacterial or botanical origin, i.e. produced by fermentation or extracted from vegetables, plants, fruits or wood. Cellulose fiber sources may be selected from the group consisting of citrus peels, such as lemons, oranges and/or grapefruit; fruits, such as apples, bananas and/or pear; vegetables such as carrots, peas, potatoes and/or chicory; plants such as bamboo, jute, abaca, flax, cotton and/or sisal, cereals, and different wood sources such as spruces, eucalyptus and/or oak. Preferably, the cellulose fibers source is selected from the group consisting of wood or plants, in particular, spruce, eucalyptus, jute, and sisal.

The cellulose fibers are preferably non-ionic. Such fibers are commercially available, for instance Citri-Fi 100FG from Fiberstar, Herbacel® Classic from Herbafood, and Exilva® from Borregaard.

Processes of Making a Fabric Softener Composition

The compositions of the present invention can be formulated into any suitable form and prepared by any process chosen by the formulator, non-limiting examples of which are described in Applicant's examples and in US 2013/0109612 A1 which is incorporated herein by reference.

The compositions disclosed herein may be prepared by combining the components thereof in any convenient order and by mixing, e.g., agitating, the resulting component combination to form a phase stable fabric care composition. A fluid matrix may be formed containing at least a major proportion, or even substantially all, of the fluid components with the fluid components being thoroughly admixed by imparting shear agitation to this liquid combination. For example, rapid stirring with a mechanical stirrer may be employed.

Figure 2:
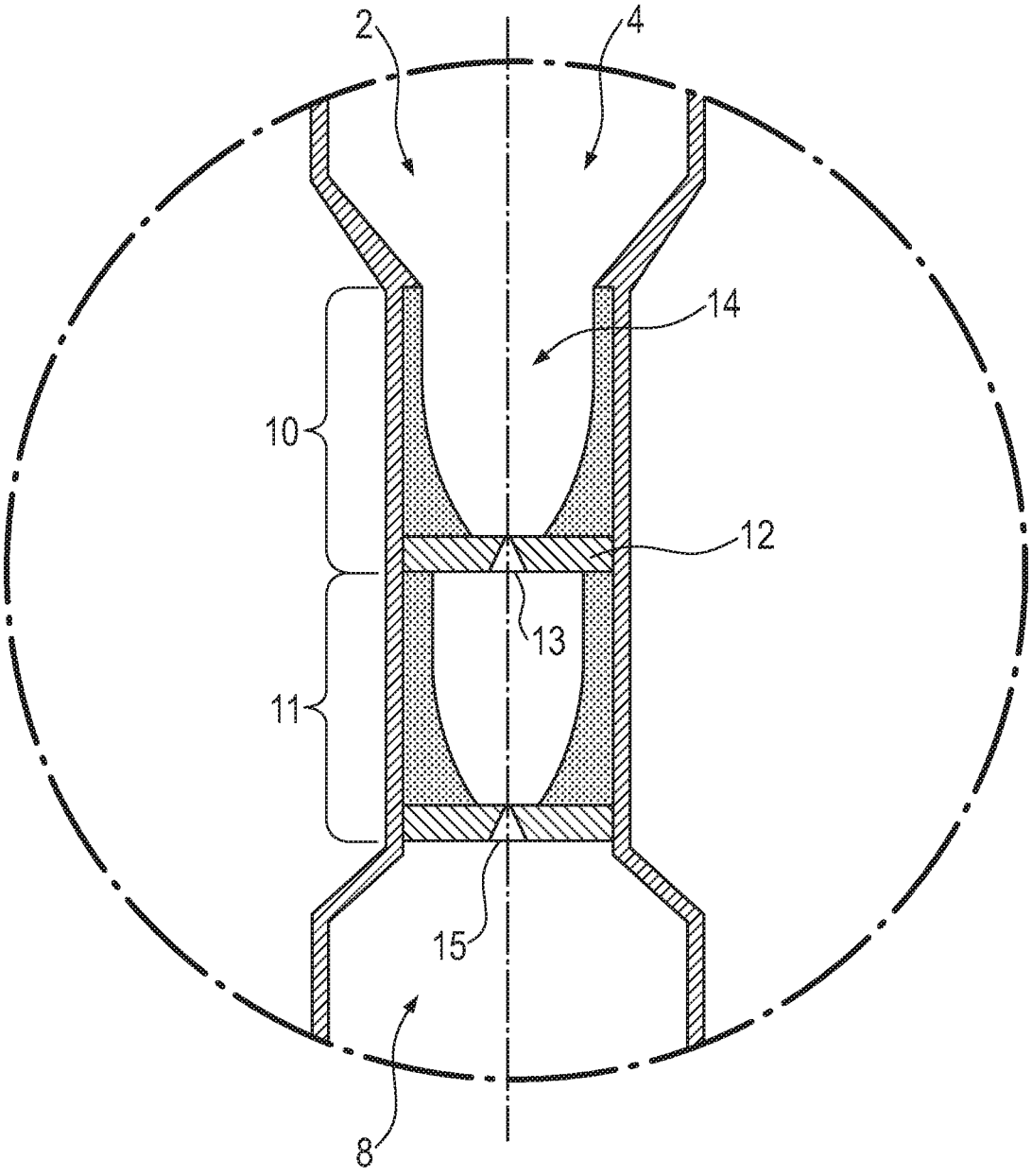
FIG. 2 details the orifice component 5 of Apparatus A.
Figure 3:
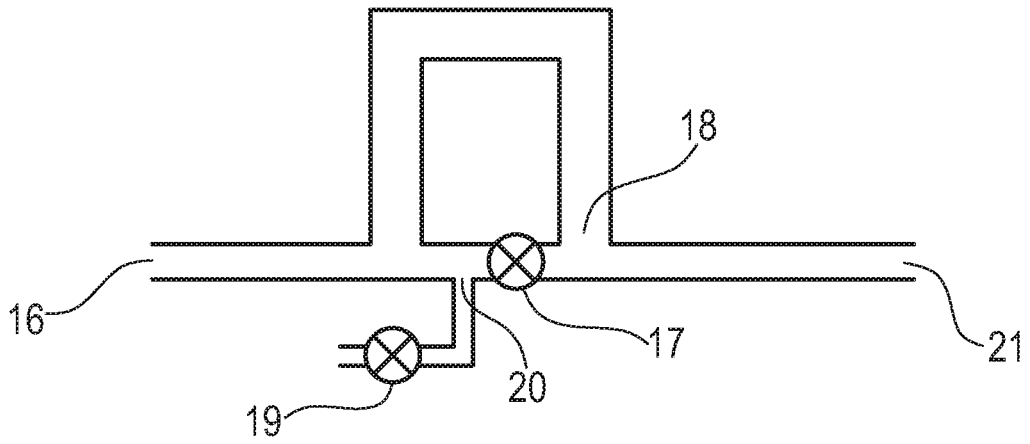
FIG. 3 details Apparatus B.

The liquid fabric softener compositions described herein can also be made as follows:

Taking an apparatus A (see FIG. 1) comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear and/or turbulence in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear and/or turbulence in the liquid, the inlet 1A, pre-mixing chamber 2, the orifice component 5 and secondary mixing chamber 8 are linear and in straight line with each other, at least one outlet 9 being located at the downstream end of the secondary mixing chamber 8; the orifice component 5 comprising at least one orifice unit, a specific example, as shown in FIG. 2, is that the orifice component 5 comprises two orifice units 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighboring orifice plates are distinct from each other;

connecting one or more suitable liquid pumping devices to the first inlet 1A and to the second inlet 1B;

pumping a second liquid composition into the first inlet 1A, and, pumping a liquid fabric softener active composition into the second inlet 1B, wherein the operating pressure of the apparatus is from 2.5 bar to 50 bar, from 3.0 bar to 20 or from 3.5 bar to 10 bar the operating pressure being the pressure of the liquid as measured in the first inlet 1A near to inlet 1B. The operating pressure at the outlet of apparatus A needs to be high enough to prevent cavitation in the orifice;

allowing the liquid fabric softener active and the second liquid composition to pass through the apparatus A at a desired flow rate, wherein as they pass through the apparatus A, they are dispersed one into the other, herein, defined as a liquid fabric softener intermediate.

passing said liquid fabric softener intermediate from Apparatus A's outlet, to Apparatus B's (FIG. 3) inlet 16 to subject the liquid fabric softener intermediate to additional shear and/or turbulence for a period of time within Apparatus B.

circulating said liquid fabric softener intermediate within apparatus B with a circulation Loop pump 17 at a Circulation Loop 18 Flow Rate equal to or greater than said inlet liquid fabric softener intermediate flow rate in said Circulation Loop System. A tank, with or without a recirculation loop, or a long conduit may also be employed to deliver the desired shear and/or turbulence for the desired time.

adding by means of a pump 19, piping and in-line fluid injector 20, an adjunct fluid, in one aspect, but not limited to a dilute salt solution, into Apparatus B to mix with the liquid fabric softener intermediate allowing the liquid fabric softener composition with the desired microstructure to exit Apparatus B 21 at a rate equal to the inlet flow rate into Apparatus B.

passing said liquid fabric softener composition exiting Apparatus B outlet through a heat exchanger to be cooled to ambient temperature, if necessary.

discharging the resultant liquid fabric softener composition produced out of the outlet of the process.

The process comprises introducing, in the form of separate streams, the fabric softener active in a liquid form and a second liquid composition comprising other components of a fabric softener composition into the pre-mixing chamber 2 of Apparatus A so that the liquids pass through the orifice component 5. The fabric softener active in a liquid form and the second liquid composition pass through the orifice component 5 under pressure. The fabric softener active in liquid form and the second liquid composition can be at the same or different operating pressures. The orifice component 5 is configured, either alone, or in combination with some other component, to mix the liquid fabric softener active and the second liquid composition and/or produce shear and/or turbulence in each liquid, or the mixture of the liquids.

The liquids can be supplied to the apparatus A and B in any suitable manner including, but not limited to through the use of pumps and motors powering the same. The pumps can supply the liquids to the apparatus A under the desired operating pressure. In one embodiment, an '8 frame block-style manifold' is used with a 781 type Plunger pump available from CAT pumps (1681 94th Lane NE, Minneapolis, Minn. 55449).

The operating pressure of conventional shear and/or turbulence apparatuses is typically between 2 bar and 490 bar. The operating pressure is the pressure of the liquid in the inlet 1A near inlet 1B. The operating pressure is provided by the pumps.

The operating pressure of Apparatus A is measured using a Cerphant T PTP35 pressure switch with a RVS membrane, manufactured by Endress Hauser (Endress+Hauser Instruments, International AG, Kaegenstrasse 2, CH-4153, Reinach). The switch is connected with the inlet 1A near inlet 1B using a conventional thread connection (male thread in the pre-mix chamber housing, female thread on the Cerphant T PTP35 pressure switch).

The operating pressure of Apparatus A may be lower than conventional shear and/or turbulence processes, yet the same degree of liquid mixing is achievable as seen with processes using conventional apparatuses. Also, at the same operating pressures, the process of the present invention results in better mixing than is seen with conventional shear and/or turbulence processes.

As the fabric softener active and the second liquid composition flow through the Apparatus A, they pass through the orifices 13 and 15 of the orifice component 5. As they do, they exit the orifice 13 and/or 15 in the form of a jet. This jet produces shear and/or turbulence in the fabric softener active and the second liquid composition, thus dispersing them one in the other to form a uniform mixture.

In conventional shear and/or turbulence processes, the fact that the liquids are forced through the orifice 13 and/or 15 under high pressure causes them to mix. This same degree of mixing is achievable at lower pressures when the liquids are forced through a series of orifices, rather than one at a high pressure. Also, at equivalent pressures, the process of the present invention results in better liquid mixing than shear and/or turbulence processes, due to the fact that the liquids are now forced through a series of orifices.

A given volume of liquid can have any suitable residence time and/or residence time distribution within the apparatus A. Some suitable residence times include, but are not limited to from 1 microsecond to 1 second, or more. The liquid(s) can flow at any suitable flow rate through the apparatus A. Suitable flow rates range from 1 to 1 500 L/min, or more, or any narrower range of flow rates falling within such range including, but not limited to from 5 to 1 000 L/min.

For Apparatus B Circulating Loop System example, one may find it convenient to characterize the circulation flow by a Circulation Loop Flow Rate Ratio which is equal to the Circulation Flow Rate divided by the Inlet Flow Rate. Said Circulation Loop Flow Rate Ratio for producing the desired fabric softener composition microstructure can be from 1 to 100, from 1 to 50, and even from 1 to 20. The fluid flow in the circulation loop imparts shear and turbulence to the liquid fabric softener to transform the liquid fabric softener intermediate into a desired dispersion microstructure.

The duration of time said liquid fabric softener intermediate spends in said Apparatus B may be quantified by a Residence Time equal to the total volume of said Circulation Loop System divided by said fabric softener intermediate inlet flow rate. Said Circulation Loop Residence Time for producing desirable liquid fabric softener composition microstructures may be from 0.1 seconds to 10 minutes, from 1 second to 1 minute, or from 2 seconds to 30 seconds. It is desirable to minimize the residence time distribution.

Shear and/or turbulence imparted to said liquid fabric softener intermediate may be quantified by estimating the total kinetic energy per unit fluid volume. The kinetic energy per unit volume imparted in the Circulation Loop System to the fabric softener intermediate in Apparatus B may be from 10 to 1 000 000 $g \cdot cm^{-1} \cdot s^{-2}$, from 50 to 500 000 $g \cdot cm^{-1} \cdot s^{-2}$, or from 100 to 100 000 $g \cdot cm^{-1} \cdot s^{-2}$. The liquid(s) flowing through Apparatus B can flow at any suitable flow rate. Suitable inlet and outlet flow rates range from 1 to 1 500 L/min, or more, or any narrower range of flow rates falling within such range including, but not limited to from 5 to 1 000 L/min. Suitable Circulation Flow Rates range from 1 L/min to 20 000 L/min or more, or any narrower range of flow rates falling within such range including but not limited to from 5 to 10 000 L/min. Apparatus A is ideally operated at the same time as Apparatus B to create a continuous process. The liquid fabric softener intermediate created in Apparatus A may also be stored in a suitable vessel and processed through apparatus B at a later time.

The pentaerythritol ester may be added to the liquid fabric softener composition as a separate ingredient or can be premixed with the quaternary ammonium ester softening active prior to the making of the liquid fabric softener composition, or preferably premixed with the perfume prior to making the liquid fabric softener composition. Premixing pentaerythritol ester with perfume further improves viscosity stability and reduces formulation complexity at the same time because a perfume-pentaerythritol mixture can be dosed with one dosing system instead of two dosing systems.

METHODS

Method of Determining pH of a Fabric Softener Composition

The pH is measured on the neat fabric softener composition at 25° C., using a Sartorius PT-10P pH meter with gel-filled probe (such as the Toledo probe, part number 52 000 100), calibrated according to the instructions manual.

Method of Determining Viscosity of a Fabric Softener Composition

The viscosity of neat fabric softener composition is determined using a Brookfield® DV-E rotational viscometer, at 60 rpm, at 21° C. Spindle 2 is used for viscosities from 50 mPa·s to 400 mPa·s. Spindle 3 is used for viscosities from 401 mPa·s to 2.0 Pa·s.

Method of Measuring Iodine Value of a Quaternary Ammonium Ester Fabric Softening Active:

The iodine value ("IV") of a quaternary ammonium ester fabric softening active is the iodine value of the parent fatty acid from which the fabric softening active is formed, and is defined as the number of grams of iodine which react with 100 grams of parent fatty acid from which the fabric softening active is formed.

First, the quaternary ammonium ester fabric softening active is hydrolysed according to the following protocol: 25 g of fabric softener composition is mixed with 50 mL of water and 0.3 mL of sodium hydroxide (50% activity). This mixture is boiled for at least an hour on a hotplate while avoiding that the mixture dries out. After an hour, the mixture is allowed to cool down and the pH is adjusted to neutral (pH between 6 and 8) with sulfuric acid 25% using pH strips or a calibrated pH electrode.

Next the fatty acid is extracted from the mixture via acidified liquid-liquid extraction with hexane or petroleum ether: the sample mixture is diluted with water/ethanol (1:1) to 160 mL in an extraction cylinder, 5 grams of sodium chloride, 0.3 mL of sulfuric acid (25% activity) and 50 mL of hexane are added. The cylinder is stoppered and shaken for at least 1 minute. Next, the cylinder is left to rest until 2 layers are formed. The top layer containing the fatty acid in hexane is transferred to another recipient. The hexane is then evaporated using a hotplate leaving behind the extracted fatty acid.

Next, the iodine value of the parent fatty acid from which the fabric softening active is formed is determined following ISO3961:2013. The method for calculating the iodine value of a parent fatty acid comprises dissolving a prescribed amount (from 0.1-3 g) into 15 mL of chloroform. The dissolved parent fatty acid is then reacted with 25 mL of iodine monochloride in acetic acid solution (0.1M). To this, 20 mL of 10% potassium iodide solution and 150 mL deionised water is added. After the addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acid enables the iodine value to be calculated.

Method of Determining Partition Coefficient

The partition coefficient, P, is the ratio of concentrations of a compound in a mixture of two immiscible phases at equilibrium, in this case n-Octanol/Water. The value of the log of the n-Octanol/Water Partition Coefficient (log P) can be measured experimentally using well known means, such as the "shake-flask" method, measuring the distribution of the solute by UV/VIS spectroscopy (for example, as described in "The Measurement of Partition Coefficients", Molecular Informatics, Volume 7, Issue 3, 1988, Pages 133-144, by Dearden J C, Bresnan). Alternatively, the log P can be computed for each PRM in the perfume mixture being tested. The log P of an individual PRM is preferably calculated using the Consensus log P Computational Model, version 14.02 (Linux) available from Advanced Chemistry Development Inc. (ACD/Labs) (Toronto, Canada) to provide the unitless log P value. The ACD/Labs' Consensus log P Computational Model is part of the ACD/Labs model suite.

EXAMPLES

The following examples and descriptions further describe preferred aspects of the present invention. These examples are given solely for the purpose of illustration and are not to be construed as limitations of the present invention as many variations thereof are possible.

Fabric softener composition Example 1 to 5 were prepared by first preparing a dispersion of the quaternary ammonium ester softener active ("FSA") using Apparatus A and B in a continuous fluid making process with 3 orifices (see Mtehods). Heated FSA at 81° C. and heated deionized water at 65° C. containing adjunct materials NaHEDP chelant, HCl, formic acid, and the preservative were fed using positive displacement pumps, through Apparatus A, and through Apparatus B, a circulation loop fitted with a centrifugal pump. The liquid fabric softener composition was immediately cooled to 25° C. with a plate heat exchanger. The total flow rate was 3.1 Kg/min; pressure at Apparatus A Inlet was 5 bar; pressure at Apparatus A Outlet was 2.5 bar; Apparatus B Circulation Loop Flow rate Ratio 8.4; Apparatus B Kinetic Energy 18000 $g \cdot cm^{-1} \cdot s^{-2}$; Apparatus B Residence Time 14 s; Apparatus B Outlet pressure was 3 bar.

The liquid fabric softener compositions were finished by adding the remaining ingredients as provided in Table 1 below using a Ytron-Y high speed mixer operated at 20 Hz for 15-20 mins. When present, the stabilizer was added was premixed with the perfume prior to addition to the dispersion of quaternary ammonium ester softener active. Different stabilizers were tested:

TEC: triethylcitrate

IPM: isopropylmyristate

GDC: propylene glycol dicaprylate/dicaprate (Radia® 7202, supplied by Oleon)

PTC: pentaerythrityl tetracaprylate/caprate (Radia® 7178, supplied by Oleon)

TABLE 1

Liquid Fabric Softener compositions Examples 1 through 5. The examples marked with an asterisk (*) are comparative examples. The viscosity was measured at 21° C. with a Brookfield ® DV-E at 60 rpm, spindle 2.

| | Ex. 1* | Ex. 2* | Ex. 3* | Ex. 4* | Ex. 5 |
|---|---|---|---|---|---|
| | | | Weight % | | |
| Water | Balance | Balance | Balance | Balance | Balance |
| NaHEDP | 0.007 | 0.007 | 0.007 | 0.007 | 0.007 |
| Formic acid | 0.043 | 0.042 | 0.042 | 0.042 | 0.042 |
| HCl | 0.033 | 0.033 | 0.033 | 0.033 | 0.033 |
| Proxel GXL[a] | 0.021 | 0.021 | 0.021 | 0.021 | 0.021 |
| FSA[b] | 9.04 | 8.96 | 8.95 | 8.95 | 8.96 |
| Antifoam[c] | 0.10 | 0.10 | 0.10 | 0.10 | 0.10 |
| $CaCl_2$ | 0.05 | 0.05 | 0.05 | 0.05 | 0.05 |
| Lupamine ® 1595 | 0.01 | 0.01 | 0.01 | 0.01 | 0.01 |
| Dye | 0.0076 | 0.0076 | 0.0076 | 0.0076 | 0.0076 |
| Encapsulated perfume type 1[d] | 0.25 | 0.25 | 0.25 | 0.25 | 0.25 |
| Encapsulated perfume type 2[d] | 0.95 | 0.95 | 0.95 | 0.95 | 0.95 |
| Rheovis ® CDE[e] | 0.35 | 0.30 | 0.40 | 0.33 | 0.30 |
| Perfume | 3.00 | 3.00 | 3.00 | 3.00 | 3.00 |
| Stabilizer | — | 0.95 | 0.95 | 0.95 | 0.95 |
| Stabilizer Type | — | TEC | IPM | GDC | PTC |
| Viscosity after 1 day [mPa · s] | 113 | 155 | 78 | 95 | 69 |

TABLE 1-continued

Liquid Fabric Softener compositions Examples 1 through 5. The examples marked with an asterisk (*) are comparative examples. The viscosity was measured at 21° C. with a Brookfield ® DV-E at 60 rpm, spindle 2.

| | Ex. 1* | Ex. 2* | Ex. 3* Weight % | Ex. 4* | Ex. 5 |
|---|---|---|---|---|---|
| Viscosity after 2 weeks storage at 30° C. [mPa · s] | 828 (+715) | 1224 (+1069) | 280 (+202) | 142 (+47) | 122 (+53) |
| Viscosity after 20 weeks storage at 30° C. [mPa · s] | stopped | stopped | 331 (+253) | 800 (+705) | 246 (+177) |
| Viscosity after 24 weeks storage at 30° C. [mPa · s] | stopped | stopped | 408 (+330) | 735 (+640) | 252 (+183) |

[a]Proxel GXL, 20% aqueous dipropylene glycol solution of 1,2-benzisothiazolin-3-one, supplied by Lonza. This material is part of the dispersion that is made and is not added at another point in the process.
[b]Mixture of bis-(2-hydroxypropyl)-dimethylammonium methylsulfate fatty acid ester, (2-hydroxypropyl)-(1-methyl-2hydroxyethyl)-dimethylammonium methylsulfate fatty acid ester, bis-(1-methyl-2hydroxyethyl)-dimethylammonium methylsulfate fatty acid ester. The iodine value of the parent fatty acid of this material is between 18 and 22. The material as obtained from Evonik contains impurities in the form of free fatty acid and the monoester.
[c]MP10 ®, supplied by Dow Corning, 8% activity.
[d]as described in U.S. Pat. No. 8,940,395, expressed as 100% encapsulated perfume oil
[e]Rheovis ® CDE, cationic polymeric thickener supplied by BASF When the viscosity of a fabric softener composition changes over time, this can hinder proper use of the composition and can be perceived as a sign of composition degradation. Especially increasing viscosity can be of concern as it further complicates accurate dosing of the fabric softener composition and may lead to residues in the washing machine dispenser. Comparative example 1 was the reference which did not comprise any stabilizer and which showed a viscosity increase of 715 mPa·s after 2 weeks storage at 30° C. The addition of TEC led to higher viscosity increase of 1069 mPa·s after 2 weeks storage at 30° C. Because viscosities higher than 800 mPa·s can be considered as unfit for use, the stability tests of Ex. 1 and 2 were stopped after 2 weeks storage at 30°. Other stabilizers, IPM (ex. 3), GDC (ex. 4), and PTC (ex. 5) led to an improved viscosity stability as compared to the reference of Ex. 1. Stabilizer PTC as demonstrated in Ex. 5 according to the present invention, provided consistently the most stable viscosity profile upon long term storage at elevated temperature.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid fabric softener composition, comprising by weight of the composition:

from about 4% to about 15% of a quaternary ammonium ester softening active, wherein the quaternary ammonium ester softening active is formed from a parent fatty acid, wherein the iodine value of the parent fatty acid is from about 5 to about 60;

from about 0.1% to about 7% of dispersed perfume; and from about 0.8% to about 1.2% of a pentaerythritol ester according to formula

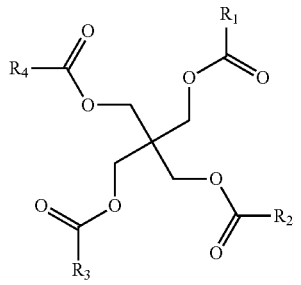

wherein each of $R_1$, $R_2$, $R_3$, and $R_4$ is independently selected from C3-C15 linear or branched, saturated or unsaturated, alkyl chains.

2. The liquid fabric softener composition according to claim 1 wherein each of $R_1$, $R_2$, $R_3$, and $R_4$ is independently selected from C6-C12 linear, saturated or unsaturated, alkyl chains.

3. The liquid fabric softener composition according to claim 1, wherein the quaternary ammonium ester softening active has the following formula:

$$\{R^2_{(4-m)}—N+-[X—Y-R^1]_m\}A-$$

wherein:

m is 1, 2 or 3 with proviso that the value of each m is identical;

each $R^1$ is independently hydrocarbyl, or branched hydrocarbyl group;

each $R^2$ is independently a $C_1$-$C_3$ alkyl or hydroxyalkyl group;

each X is independently —$(CH_2)_n$—, —$CH_2$—CH($CH_3$)— or —CH($CH_3$)—$CH_2$— and each n is independently 1, 2, 3 or 4;

each Y is independently —O—(O)C— or —C(O)—O—;

A- is independently selected from the group consisting of chloride, methyl sulfate, and ethyl sulfate;

with the proviso that when Y is —O—(O)C—, the sum of carbons in each $R^1$ is from about 13 to about 21.

4. The liquid fabric softener composition according to claim 1, wherein the quaternary ammonium ester softening active has the following formula:

$$\{R^2_{(4-m)}—N+-[X—Y-R^1]_m\}A-$$

wherein:

m is 1, 2 or 3 with proviso that the value of each m is identical;

each $R^1$ is independently hydrocarbyl, or branched hydrocarbyl group;

each $R^2$ is independently a $C_1$-$C_3$ alkyl or hydroxyalkyl group;

each X is independently —$CH_2$—CH($CH_3$)— or —CH($CH_3$)—$CH_2$—; and each n is independently 1, 2, 3 or 4;

each Y is independently —O—(O)C— or —C(O)—O—;

A- is independently selected from the group consisting of chloride, methyl sulfate, and ethyl sulfate;

with the proviso that when Y is —O—(O)C—, the sum of carbons in each $R^1$ is from about 13 to about 21.

5. The liquid fabric softener composition according to claim 1, wherein the dispersed perfume is present at a level of from about 0.5% to about 6% by weight of the composition.

6. The liquid fabric softener composition according to claim 1, wherein the ratio of pentaerythritol ester to dispersed perfume is from about 10:1 to about 1:10.

7. The liquid fabric softener composition according to claim 1, wherein the pH of the liquid fabric softener composition is from about 2.0 to about 4.5.

8. The liquid fabric softener composition according to claim 1 further comprising by weight of the composition from about 0.01% to about 5% of a rheological modifier, wherein said rheological modifier is selected from the group consisting of cationic polymers, amphoteric polymers, and polysaccharides.

9. The liquid fabric softener composition according to claim 1, wherein the liquid fabric softener composition has a viscosity from about 50 mPa·s to about 800 mPa·s, as measured with a Brookfield® DV-E rotational viscometer, spindle 2 for viscosities between about 50 mPa·s and about 400 mPa·s, spindle 3 for viscosities between about 401 mPa·s and about 800 mPa·s, at about 60 rpm, at about 21° C.

10. The liquid fabric softener composition according to claim 1 further comprising by weight of the composition from about 0.05% to about 10%, of encapsulated benefit agent.

11. A process for making the liquid fabric softener composition according to claim 1 comprising the step of premixing said pentaerythritol ester with the quaternary ammonium ester softening active and/or premixing said pentaerythritol with the perfume.

12. A process according to claim 11, wherein said pentaerythritol ester is premixed with the perfume.

13. A liquid fabric softener composition according to claim 1, comprising by weight of the composition, from about 0.9% to about 1.1% of said pentaerythritol ester.

14. A liquid fabric softener composition according to claim 1, comprising by weight of the composition, from about 0.9% to about 1.0% of said pentaerythritol ester.

15. A liquid fabric softener composition according to claim 1, comprising by weight of the composition, from about 0.95% of said pentaerythritol ester.

* * * * *